United States Patent [19]

Jones

[11] Patent Number: 4,907,994

[45] Date of Patent: Mar. 13, 1990

[54] L-DRIVE

[75] Inventor: David D. Jones, Mequon, Wis.

[73] Assignee: US Marine Corporation, Hartford, Wis.

[21] Appl. No.: 62,244

[22] Filed: Jun. 15, 1987

[51] Int. Cl.[4] ..... B63H 5/12

[52] U.S. Cl. ..... 440/61; 440/75; 440/111

[58] Field of Search ..... 440/49, 53–65, 440/75, 111, 112

[56] References Cited

U.S. PATENT DOCUMENTS

| | | | |
|---|---|---|---|
| 1,011,930 | 12/1911 | Evinrude . | |
| 1,234,370 | 7/1917 | Meyer . | |
| 1,737,180 | 11/1929 | Willis . | |
| 1,765,789 | 6/1930 | Ditchburn . | |
| 1,774,956 | 9/1930 | Wilson . | |
| 1,824,213 | 9/1931 | Johnson | 440/59 |
| 1,824,887 | 9/1931 | Harvey . | |
| 1,900,180 | 3/1933 | Harvey . | |
| 1,911,192 | 5/1933 | Harvey . | |
| 2,064,463 | 12/1936 | Crosley, Jr. . | |
| 2,209,302 | 7/1940 | Johnson et al. . | |
| 2,466,635 | 4/1949 | Brown et al. . | |
| 2,633,817 | 4/1953 | Pedranti . | |
| 2,917,019 | 12/1959 | Krueger . | |
| 2,948,252 | 8/1960 | Alexander . | |
| 2,975,750 | 3/1961 | Smith . | |
| 2,976,836 | 3/1961 | Fageol | 440/112 |
| 3,029,769 | 4/1962 | Kiekhaefer . | |
| 3,148,657 | 9/1964 | Horning . | |
| 3,164,122 | 1/1965 | Fageol . | |
| 3,170,436 | 2/1965 | Deutch . | |
| 3,422,780 | 1/1969 | Becker et al. . | |
| 3,440,743 | 4/1969 | Divine | 440/69 |
| 3,659,547 | 5/1972 | Stuart | 440/69 |
| 3,702,485 | 11/1972 | Thompson | 440/69 |
| 3,745,963 | 7/1973 | Fisher | 440/70 |
| 3,752,111 | 8/1973 | Meynier, Jr. . | |
| 3,807,437 | 4/1974 | Baldwin . | |
| 3,811,399 | 5/1974 | Kobayashi et al. | 440/69 |
| 3,834,345 | 9/1974 | Hager et al. | 440/61 |
| 4,040,378 | 8/1977 | Blanchard | 440/52 |
| 4,236,478 | 12/1980 | Maasson | 440/112 |
| 4,371,348 | 2/1983 | Blanchard | 440/88 |
| 4,371,350 | 2/1983 | Kruppa et al. | 440/69 |
| 4,464,128 | 8/1984 | Aso et al. | 440/112 |
| 4,501,560 | 2/1985 | Brandt et al. | 440/53 |
| 4,543,068 | 9/1985 | Brandt et al. | 440/53 |
| 4,543,069 | 9/1985 | Kobayashi | 440/112 |

FOREIGN PATENT DOCUMENTS

| | | | |
|---|---|---|---|
| 227593 | 12/1984 | Japan | 440/53 |

*Primary Examiner*—Joseph F. Peters, Jr.
*Assistant Examiner*—Jesûs D. Sotelo
*Attorney, Agent, or Firm*—Lewis L. Lloyd

[57] ABSTRACT

A propeller drive for a boat which provides independent steering and independent trimming/tilting mounts through a hole in a bottom surface of the boat. Steering of the propeller drive is provided by a steering assembly constructed to rotate about a generally vertical axis for connecting the drive up through the hole in the boat. Trimming of the propeller drive is provided by a trimming assembly which is pivotally connected to swing the propeller drive generally horizontally from the steering assembly.

15 Claims, 5 Drawing Sheets

L-DRIVE

BACKGROUND OF THE INVENTION

This application is related to the following applications titled: Boat Propulsion Device Ser. No. 062,449; Exhaust System for a Boat Propulsion Device Ser. No. 062,227; Boat with Cavity for a Boat Propulsion Device Ser. No. 062,459; Boat Propulsion Device with Internal Exhaust Ser. No. 062,453 and Driveshaft Housing for a Boat Propulsion Device Ser. No. 062,228, all filed concurrent herewith on June 15, 1987.

The field of the present invention relates to a boat propulsion device and more particularly concerns a propeller drive for mounting from a hole in an aft bottom surface of a boat which is swingable under the boat for steering and for trimming/tilting of the drive.

Presently there are two general types of known pleasure boat drives; the first is the inboard outboard drive or stern drive and the second is the outboard.

The prior stern drive 10, shown in schematic form in Prior Art FIGS. 1*a* through 1*d* includes an engine 11 positioned horizontally in the boat 12 and an outdrive 13 depending from the boat 12. The outdrive 13 shown in illustrative block form by representative phantom lines has a horizontal upper portion extending rearwardly from the boat transom as shown by first block 14, a vertical middle portion extending downwardly or depending from the rearward end of the upper portion generally along the transom ending below the bottom of the boat as shown by the second block 15, and a horizontal lower portion extending rearwardly from the bottom of the vertical portion to a propeller 16 as shown by the third block 17.

The stern drive 10 includes drive-line shaft components which begin at the horizontal crankshaft of the engine 11 and extend to the propeller 16. As shown in FIG. 1*a*, these shaft components shown by representative heavy dashed lines include a horizontal upper drive shaft assembly 18 which includes a first portion 19, a second portion 20 and a connecting universal joint 21; a vertical drive shaft 22 and a propeller shaft 23.

The outdrive 13 is mounted on the transom 24 of the boat 12 with a gimbal assembly 25 as illustrated in FIG. 1*d*. The gimbal assembly 25 contains a vertical pivot 26 on vertical axis 27 and a horizontal pivot 28 on horizontal axis 29. The outdrive 13 turns from side-to-side as shown by arrow 27*a* on the vertical axis 27 for steering and swings up-and-down as shown by arrow 29*a* on the horizontal axis 29 for trimming/tilting.

Although the stern drive 10 has evolved into a satisfactory type boat drive, it has certain design complexities which increase the size and weight as well as the cost. One complexity is the outdrive 13 shown by the three blocks 14, 15, and 17 which is clearly not only heavy but also provides an overhanging weight which requires extra strength in certain components. Some of these components such as the horizontal pivot 28 of the gimbal assembly 25 must carry the entire weight of the outdrive 13. In addition, the large aluminum parts of the outdrive 13 are subject to cathodic and salt water corrosion.

The prior outboard 40 is shown in schematic form in Prior Art FIGS. 2*a* through 2*c*. The outboard 40 unlike the stern drive 10 is a unit assembly of a vertical engine 41, a midsection 42 positioned below the engine 41 and a lower unit 43 having a propeller 44. The outboard 40 is shown in block form by representative phantom lines in FIGS. 2*a*, 2*b* and 2*c*. The midsection 42 is shown by a fourth block 45 and the lower unit 43 by a fifth block 46.

The outboard 40 also contains drive-line components which begin at a vertical crankshaft of the engine 41 and extend to the propeller 44. These drive-line components are integral within the unit assembly and unlike the stern drive 10 have a fixed drive angle.

The outboard 40 is mounted on the transom 49 of boat 50 with a transom mounting bracket 51 and swivel bracket 52 as shown in FIGS. 2*a* and 2*d*. As shown in FIGS. 2*c* and 2*d* the swivel bracket 52 includes a vertical swivel bracket pivot 53 having a vertical swivel bracket pivot axis 54 and a horizontal swivel bracket pivot 55 having a horizontal swivel bracket pivot axis 56. The outboard 40 turns from side-to-side on the vertical swivel bracket pivot axis 54 as shown by the arrow 54*a* for steering and swings up-and-down on the horizontal swivel bracket pivot axis 56 as shown by the arrow 56*a* for trimming/tilting. Unlike the stern drive 10, the outboard vertical steering axis moves with the outboard movement as shown in FIG. 2*d*. This is best understood by comparing first steering axis 57 of the outboard in about full in-trim position with the second steering axis 58 of the outboard in about full up-tilt position.

Although the outboard 40 is a satisfactory boat drive, inherent in its design as a unit assembly for attachment over the transom is the need to support weight of the entire unit assembly off the transom of the boat. With small horsepower this is satisfactory, but as the horsepower becomes larger the weight and size places overhanging loads on the transom. The outboard 40 also requires a large engine cover or cowl which provides a bulky appearance. Also, clearance is required in the boat forward and inside the transom to accommodate the engine cowl when the engine is in the full up-tilt position. In addition, the steering arm 59, as shown in FIG. 2*c*, moves with the outboard 40 when the outboard pivots about the horizontal swivel bracket pivot axis 56. This motion is different at different trim/tilt positions resulting in the need for a complex boat steering system.

Other prior drives for boats mount through the bottom of the boat. These prior drive types are described in U.S. Pat. No. 2,209,302 to L. J. Johnson et al as well as in U.S. Pat. Nos. 2,976,836 and 3,164,122 to L. J. Fageol.

SUMMARY OF THE INVENTION

In the present invention a boat propulsion device mounts through a raised bottom surface of a boat. The boat propulsion device includes a drive under and extending to the rear of the boat which steers and trim/-tilts. Steering is obtained by swinging the drive from side to side and trimming is obtained by swinging the drive up and down. Both steering and trimming are achieved with simple, low cost and low weight mechanisms overcoming many of the disadvantages of the prior devices while retaining their advantages.

The drive mounts simply through a hole in a bottom surface of the boat through a mounting assembly which is less complex and of lower weight than the transom bracket of the stern drive. The drive mounts through the mounting assembly with a steering assembly for rotation on a generally vertical axis to steer the drive. The trimming assembly mounts to the steering assembly on a generally horizontal axis to provide trim/tilt of the drive. The upper drive shaft rotates on the vertical axis of the steering assembly and connects to a lower drive shaft with a flexible coupling at about the generally horizontal axis to provide drive connection during trim/tilt of the drive. This mounting mechanism for the drive which is small in size and weight provides all the advantages of drive steering and drive trim/tilt.

In addition to the advantages discussed above, the boat propulsion device provides many other benefits. When compared to the prior outboard, it eliminates the overhanging requirement as well as the needed interior space for trim/tilt; it eliminates the engine cowl; and it eliminates a complex steering and trim/tilt arrangement which moves the entire outboard. When compared to the prior stern drive, it eliminates hanging the driveleg rearward, downward and outward from the boat; it eliminates the gimbal and resulting structural needs associated with mounting the gimbal for steering and trim/tilt; and, it eliminates steering and trimming the large hanging drive leg. When compared to both the outboard and the stern drive it substantially reduces the complexity and cost. Also, very importantly, it reduces the drive components outside the boat which are subject to salt and cathodic damage. When compared to other prior devices positioned through a bottom surface of a boat, it provides steering and trim/tilt of the drive under the boat. Although, the steering and trim/tilt mechanism is simple, it is believed to provide equivalent or superior operation to the prior mechanism.

DETAILED DESCRIPTION OF THE PREFERRED EMBODIMENT

L-Drive

Figure 1:
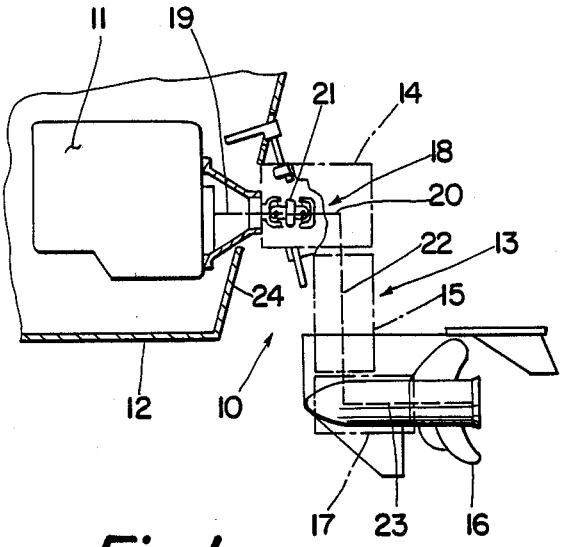
Fig. 1 PRIOR ART
FIG. 1*a* is a schematic side elevation view of a stern drive of the prior art.
FIG. 1*b* is a schematic top elevation view of the stern drive of FIG. 1*a*.
FIG. 1*c* is a schematic side elevation view of the stern drive of FIG. 1*a* in an up-tilt condition.
FIG. 1*d* is a schematic perspective to show how the steering and trim/tilt occur in the stern drive of FIG. 1*a*.
Figure 1B:
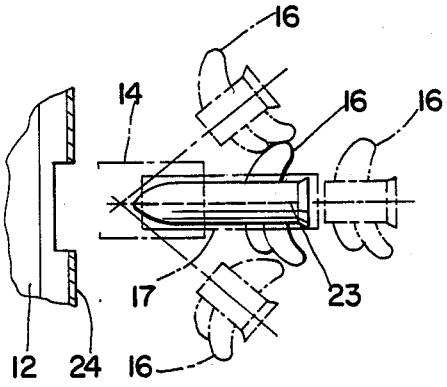
Fig. 1b PRIOR ART
Figure 1C:
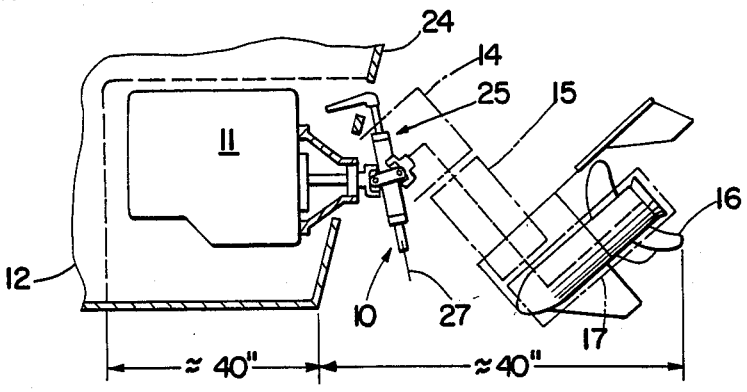
Fig. 1c PRIOR ART
Figure 1D:
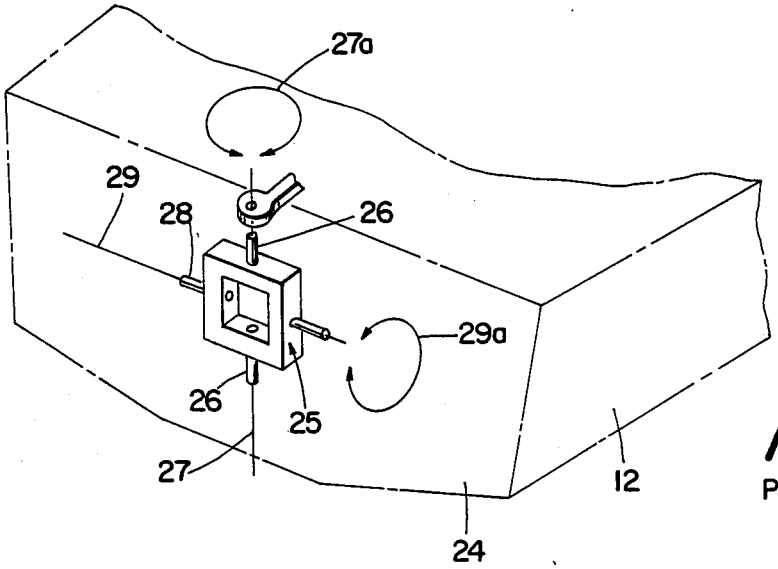
Fig. 1d PRIOR ART
Figure 2C:
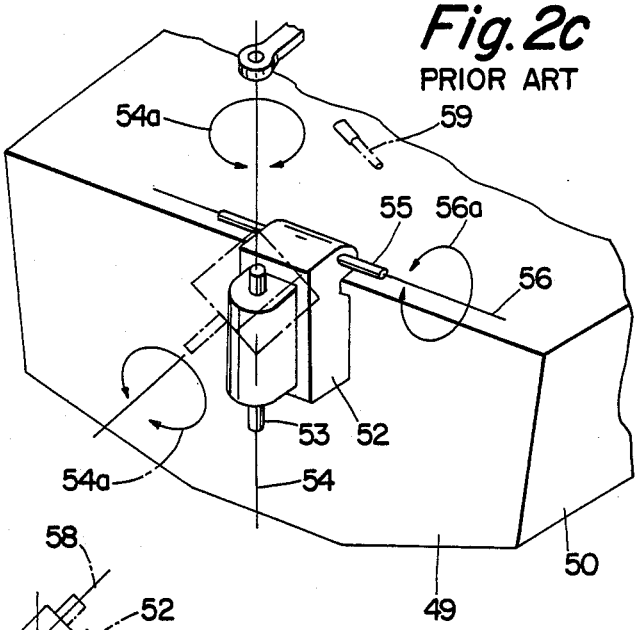
Fig. 2c PRIOR ART
FIG. 2*c* is a side elevational view of the steering assembly to show how the steering and trim/tilt occur in the outboard of FIG. 1*a*.
Figure 2D:
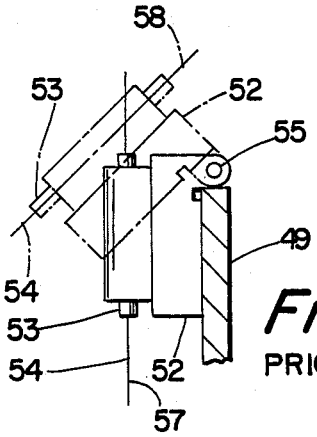
Fig. 2d PRIOR ART
FIG. 2*d* is a fragmentary schematic side elevation view to further show how the steering and trim/tilt occur in the outboard of FIG. 2*a*.
Figure 2A:
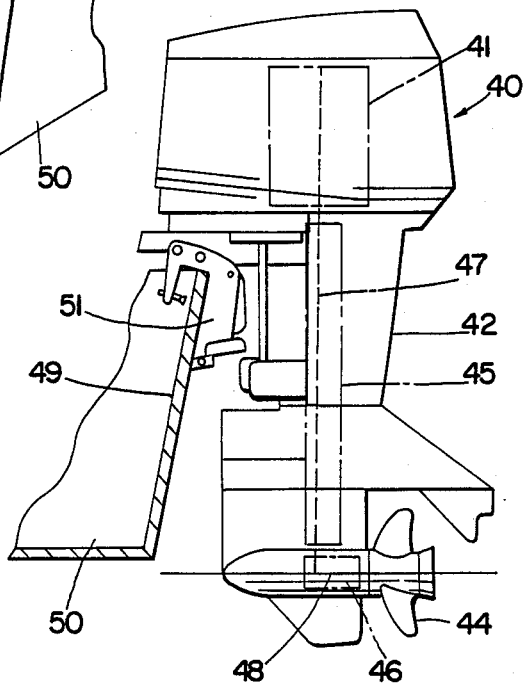
Fig. 2a PRIOR ART
FIG. 2*a* is a schematic side elevation view of an outboard of the prior art.
Figure 2B:
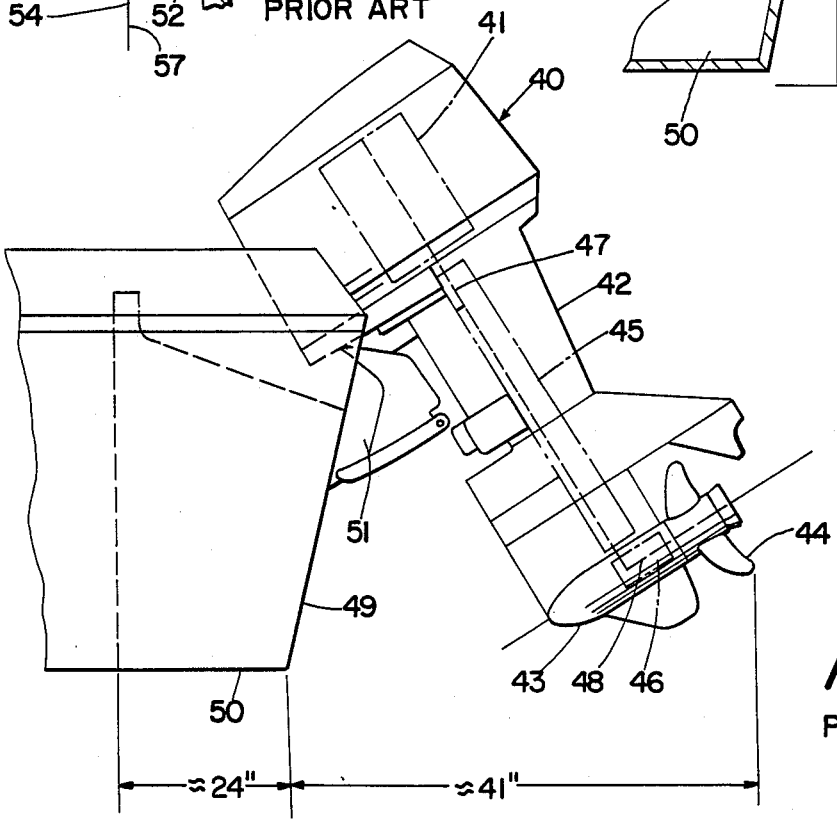
Fig. 2b PRIOR ART
FIG. 2*b* is a schematic side elevation view of the outboard of FIG. 2*a* in an up-tilt condition.
Figure 3A:
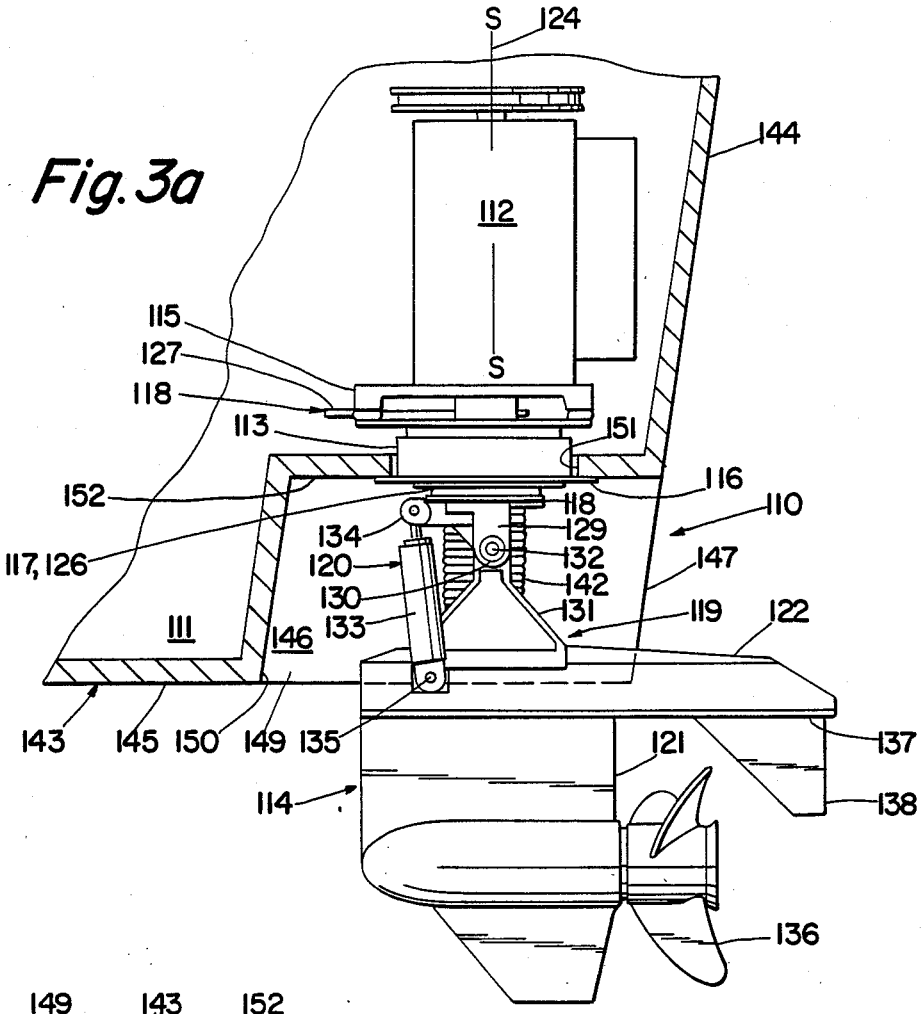
FIG. 3*a* is a side elevation view of the L-Drive of the invention.
Figure 3B:
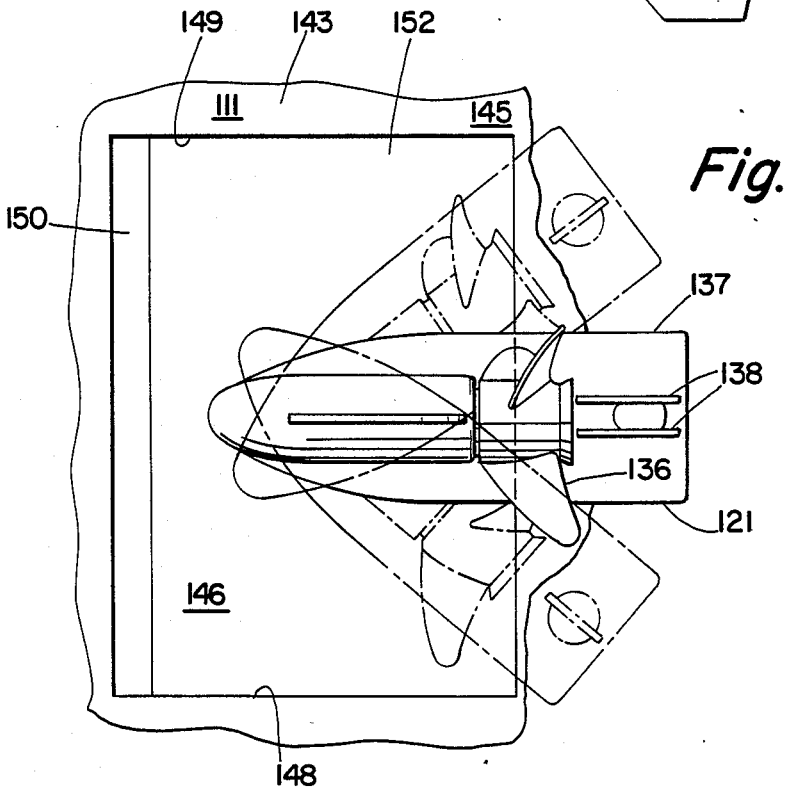
FIG. 3*b* is a bottom elevation view of the L-Drive of FIG. 3*a*.
Figure 3C:
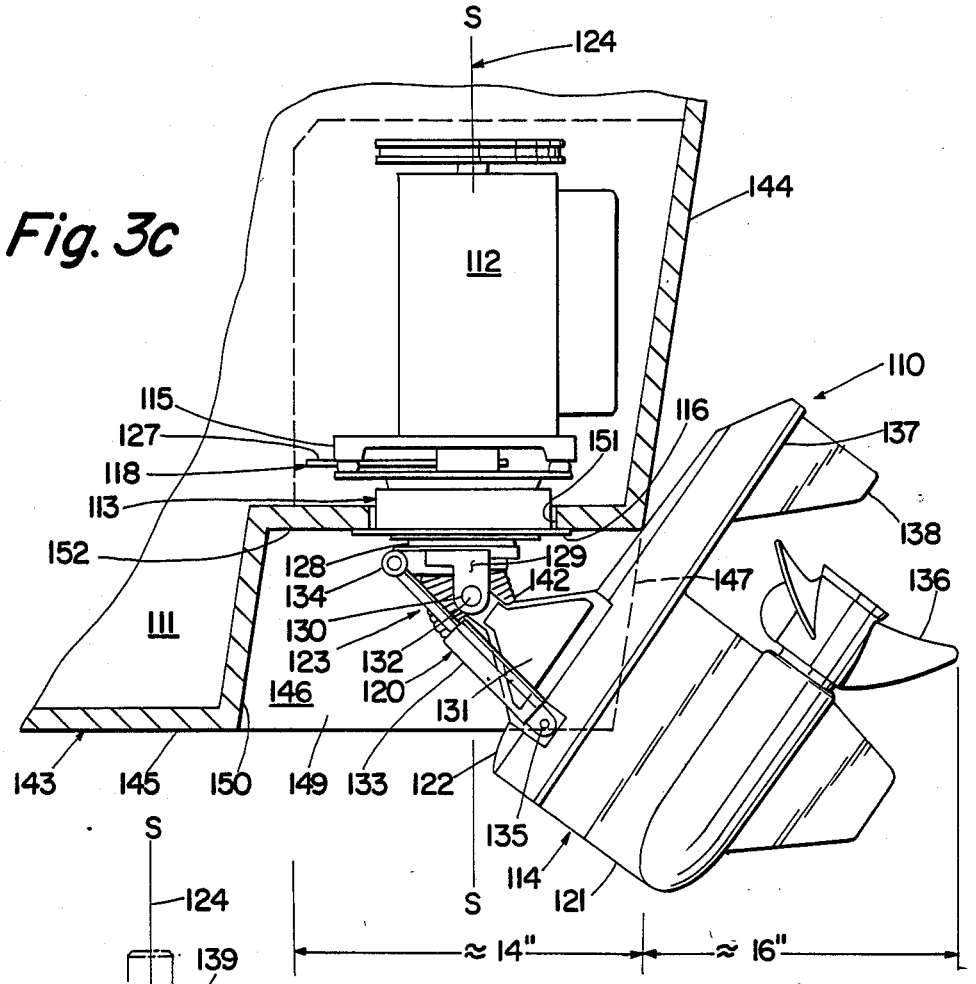
FIG. 3*c* is a side elevation view of the L-Drive of FIG. 3*a* in an up-tilt condition.

A boat propulsion device or L-Drive 110 is shown mounted on a water craft or boat 111 in FIGS. 3*a* through 3*c*. The boat propulsion device is named L-Drive with reference to the L shape formed by the vertical and horizontal portions when viewed towards the port side of a boat. The boat propulsion device 110 includes an engine 112, a mounting assembly 113 and a propeller drive or drive 114.

The engine 112 may be of either a 2 or 4 cycle internal combustion type. In the preferred embodiment an eighty five horsepower engine as used on the U.S. Marine Force outboard is used. For increased horsepower, the one hundred twenty five horsepower engine as used on the U.S. Marine Force outboard may be used. The engine 112 is prevented from movement by attachment to the mounting assembly 113. In the preferred embodiment the engine 112 is attached with the engine crankshaft (not shown) on a vertical axis and connected for power transmission as will be described.

Figure 5:
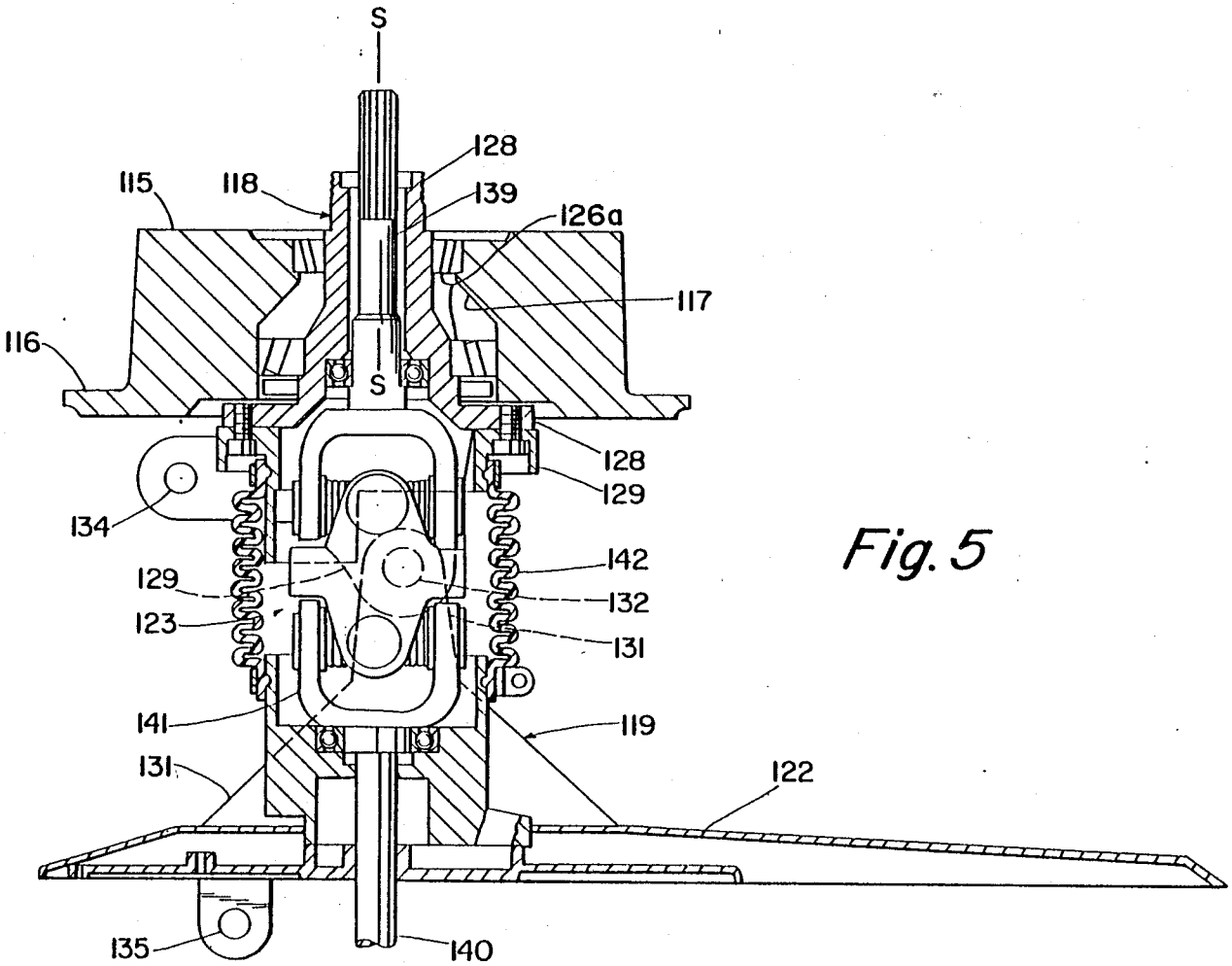
FIG. 5 is a fragmentary half section view of a portion L-Drive shown in FIG. 3*a*.

The mounting assembly 113 shown in FIGS. 3*a* and 5 includes an engine mounting portion 115 for attachment of the engine 112 to the mounting assembly 113, a boat mounting portion 116 for attachment of the mounting assembly 113 to the boat 111, and a drive mounting portion 117 for attachment of the drive 114 to the mounting assembly 113.

Figure 3D:
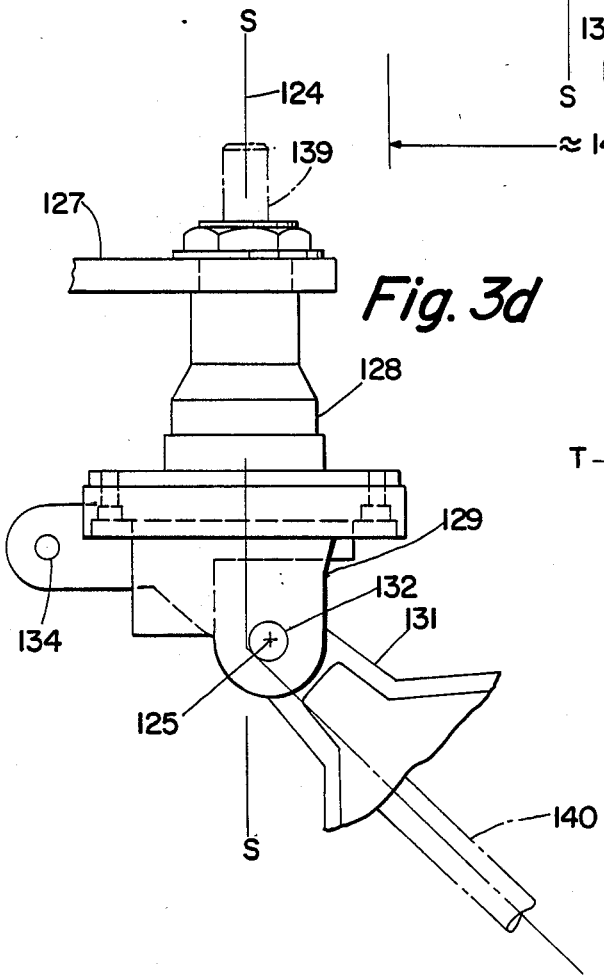
FIG. 3*d* is a schematic perspective to show how the steering and trim/tilt occur in the L-Drive of FIG. 3*a*.
Figure 4:
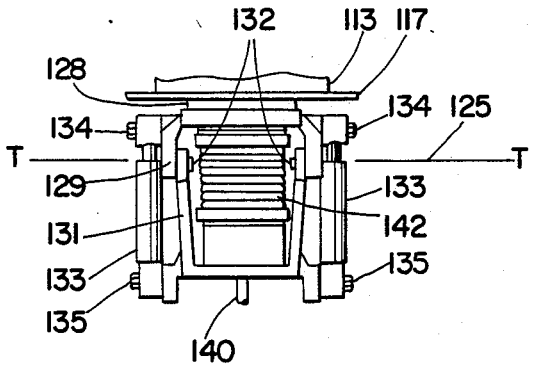
FIG. 4 is fragmentary end view showing a portion of the L-Drive of FIG. 1*a*.

The drive 110 shown in FIGS. 3*a* and 5 includes a steering assembly 118, a trimming assembly 119 with a trim adjusting system 120, a propeller drive lower unit 121, a lower unit adapter 122, and a drive shaft transmission means or drive shaft means 123. The drive 110 rotates from side-to-side about a vertical axis 124 or S—S to steer and up-and-down about a horizontal axis 125 or T—T to trim/tilt as shown in FIGS. 3*d* and 4.

The steering assembly 118 includes a steering member or spindle 126 and a steering arm 127 for rotating the steering member 126 to steer the boat 111. The steering member 126 as shown in FIGS. 3*d*, 4 and 5 is formed with an upper generally tubular portion or hollow spindle 128 which extends up through the mounting assembly 113 to a position above the mounting assembly 113 and within the engine mounting portion 115. The steering member 126 is attached to the mounting assembly 113 on bearings 126*a* to rotate on the axis S—S. The steering arm 127 is keyed (not shown) to the steering member 126 so that they rotate as one unit. The steering arm 127 is connected with a boat steering system which rotates the steering member 126 to steer the drive 114. The steering assembly 118 also includes a lower depending portion, yoke or downward trunnion 129 which provides the horizontal trimming pivot 130 for the trimming assembly 119. In FIGS. 3*d* and 4, the steering assembly 118 is shown to illustrate the relationship of the steering axis S—S and trimming axis T—T.

The trimming assembly 119 includes an upward trunnion 131 on the lower unit adapter 122 which pivotally mounts the adapter 122 to the downward trunnion 129 on the steering member 126 at trimming pivot 130. The overlapping or engaging sides of the trunnions 129 and 131 each contain a pivot pin 132. The trimming assembly 119 also utilizes a trim adjusting system 120 which includes a hydraulic trim cylinder 133 connected between a cylinder upper pivot 134 on the steering member 126 and a cylinder lower pivot 135 on the lower unit 121. Operation of the hydraulic trim cylinder 133 pivots the drive 114 up-and-down for trim/tilt.

The lower unit 121 includes the propeller 136, a propeller shaft including reversing clutch and gearing (not shown), an anticavitation plate 137 and a trim fin 138 under the anticavitation plate 137. The lower unit 121 is of known construction used in an outboard. The preferred lower unit 121 is an eighty-five horsepower lower unit used in the Force Outboard manufactured by U.S. Marine Corporation. The alternative lower unit is an one hundred twenty five horsepower lower unit used in the Force Outboard. The lower unit adapter 122 mounts to the top of the lower unit 121 to detachably interface or adapt from the lower unit 121 to the trimming assembly 119.

The drive shaft means 123 as shown in FIG. 5 includes a first or upper vertical drive shaft 139, a second or lower drive shaft 140, and a flexible coupling or universal joint 141 connecting adjacent ends of the drive shafts 139 and 140. The upper drive shaft 139 is between the engine crankshaft (not shown) and the trimming pivot 130 and the lower drive shaft 140 is between the trimming pivot 130 and the lower unit 121 attaching to the lower gearing (not shown) as is known. The upper end of the upper drive shaft 139 includes an external spline to engage the known internal spline in the engine crankshaft. The lower drive shaft 140 is generally vertical when the propeller shaft is horizontal. The upper drive shaft 139 rotates on the vertical axis S—S. The lower driveshaft 140 angles down from the upper drive shaft 139 at the universal joint 141 during trim/tilt. The upper and lower drive shafts 139 and 140 are coplanar with a plane that is perpendicular to the axis T—T of the trimming pivot 130.

The L-Drive 110 also includes a shift assembly (not shown) for operating the clutch (not shown) in the lower unit 121, an engine water cooling system including a driveshaft driven pump (not shown) and an engine exhaust system (not shown).

The Boat

The boat 111, partially shown in FIGS. 3*a* through 3*c*, includes a planing hull 143 and a generally vertical upright transom 144. The hull 143 includes a bottom planing surface 145 and a cavity 146 adjacent the transom 144. The cavity 146 extends upwardly into the hull 143 and has an open end extending through a notch 147 in the transom 144.

The cavity 146 includes a first portside wall 148, a second starboard side wall 149 and a third forward wall 150. The forward wall 150 is preferably vertically upright similar to the transom 144. The forward wall 150 is positioned as far rearward as possible against the drive 114 to provide the maximum hull bottom planing surface 145 forward of the drive 114. A hole 151 is formed in the top 152 of the cavity 146 to attach the mounting assembly 113.

Operation of the Steering and Trimming System

Steering and trimming of the L-Drive 110 is easily accomplished. To steer the boat 111, the driver turns the boat steering wheel which operates the boat steering system to turn the drive 114. To trim the boat 111, the operator operates the boat hydraulic system to power the hydraulic trim cylinder 133 to lift or lower the drive 114. The steering of the drive 114 is about the vertical axis S—S and the trimming or tilting of the drive 114 is about the horizontal axis T—T. The steering is totally independent from the trimming or tilting. In other words the operator can steer at any trim position and the operator can trim at any steered position.

The steering of the drive 114 is further described with respect to FIG. 3*a*. When the steering arm 127 is moved by the steering system of the boat 111, it rotates the steering member 126 to steer the drive 114. Steering the drive 114 redirects the propeller thrust. The redirected propeller thrust changes the forward or reverse direction of the boat 111 thereby directing or steering the boat 111 in the desired path. In FIG. 3*b* (a bottom elevation view), the drive 114 illustrates forward steering, the drive 114*a* (shown in phantom lines) illustrates steering to starboard, and the drive 114*b* (shown in phantom lines) illustrates steering to port.

The trimming of the drive is further described with respect to FIGS. 3*a* and 3*c*. When the drive 114 is being trimmed it swings up-and-down about the horizontal pivot axis T—T. Swinging of the drive 114 changes the angle of the propeller thrust direction to lift or lower the bow of the boat. The range of angular direction of the propeller thrust from a boat stopped condition to an on plane condition generally defines the range of trim. The range of tilt is upwardly from the maximum up or out trim position to the highest position available. The tilt range is used to change the propeller and to lift the drive 114 when removing the boat 111 from the water on a trailer or for transporting or storage. The propeller thrust is generally not used or available in the tilt range therefore steering generally does not occur. FIG. 3*a* shows the drive 114 in a generally operating trim position and FIG. 3*c* shows the drive 114 in a generally up-tilt position.

While an embodiment and application of the invention has been shown and described, it would be apparent to those skilled in the art that modifications are possible without departing from the inventive concepts herein. Therefore, the invention is not to be restricted other than by the scope and equivalency of the following claims.

I claim:

1. A combination steering and trimming assembly for a boat propulsion drive, said combination designed to mount through a hole in a bottom surface of the boat, the combination comprising a steering and trimming assembly including a steering assembly member extending upwardly through the hole in the bottom surface of the boat, said steering assembly member constructed to rotate about a generally vertical axis, and a trimming assembly member for trimming the drive, said trimming assembly member connecting by horizontal pivot means to said steering assembly member, said trimming assembly member constructed to rotate about a generally horizontal axis.

2. Apparatus comprising drive transmission means for an independently steerable and trimmable boat propulsion device designed to install in a boat through a hole in a bottom surface thereof, said drive transmission means including a generally vertical upper drive shaft extending through said hole, a generally vertical lower drive shaft, and an universal joint drivably connecting said upper and lower drive shafts.

3. An independently steerable and trimmable drive for mounting through a hole in a bottom surface of a boat comprising a steering assembly for connecting the drive through the hole in the bottom surface of the boat, said steering assembly constructed to rotate about a generally vertical axis, a trimming assembly for connecting the drive to said steering assembly for providing a limited range of up and down swinging movement therefrom, said trimming assembly including a horizontal pivot means for connecting said trimming assembly with said steering assembly and a trim cylinder means having one end connecting to the drive and the other end connecting to said steering assembly to provide an adjustment for selecting a desired fixed position within said range of swinging movement of the drive.

4. An independently steerable and trimmable drive for mounting through a hole in a bottom surface of a boat comprising a drive mounting assembly for mounting the drive through the hole in a bottom surface of the boat, a drive having a generally vertical first portion depending from said drive mounting assembly and a generally horizontal second portion extending outwardly from the downward end of said first portion, said first and second portions providing an L-shape to the drive, a steering and trimming assembly connecting said drive with said drive mounting assembly to provide a rotation of the drive relative to said drive mounting assembly to obtain said independent steering and to provide generally up and down pivoting of the drive with respect to said drive mounting assembly to obtain said independent trimming, said steering and trimming assembly including a portion which extends downwardly through said drive mounting assembly and is rotatable therein.

5. The drive defined in claim 4 further comprising a trim adjusting system connected with said downwardly extended portion of said steering and trimming assembly.

6. The drive defined in claim 4 wherein said trimming assembly includes a horizontal trimming pivot means.

7. An independently steerable drive for mounting through a hole in a bottom surface of the boat, a drive mounting assembly for mounting the drive through the hole in the bottom surface of the boat, the drive extending downwardly and outwardly from said drive mounting assembly, a steering and trimming assembly connecting the drive to said drive mounting assembly, said steering and trimming assembly providing trimming of said drive by up and down pivoting of the drive, a drive shaft means passing generally vertically through said steering and trimming assembly, said drive shaft means including a flexible drive connecting means for transmitting rotation through said drive shaft means during said up and down pivoting of the drive.

8. The drive defined in claim 7 wherein said drive shaft means including a first drive shaft extending generally vertically downward into said steering and trimming assembly, a second drive shaft extending generally vertically upward, and an universal joint connecting between adjacent ends of said first and second drive shafts for transmitting rotation therebetween during said trimming of the drive.

9. The drive defined in claim 8 wherein said universal joint and at least one said first and second drive shafts provide axial extension therebetween during said rotation transmitting when trimming.

10. The drive defined in claim 8 wherein the drive steers by rotating around said first drive shaft, said first drive shaft positioned in the center of rotation of said steering and trimming assembly.

11. An independently steerable and trimmable drive for mounting through a hole in the bottom surface of a boat comprising, a steering and trimming assembly for connecting the drive through the hole in a bottom surface of a boat, said steering and trimming assembly including a steering member extending upwardly through the hole in the bottom surface of the boat, said steering member constructed to rotate about a generally vertical axis, said steering member including a trimming member having trim adjustment means mounted thereto and extending downward therefrom for trimming the drive, said trimming member constructed to rotate with said steering member about a generally vertical axis.

12. The drive defined in claim 11 wherein said steering and trimming assembly includes horizontal pivot means, said drive further comprising a drive shaft means, said drive shaft means including a generally vertical first drive shaft extending upward through said steering member connecting with a generally vertical second drive shaft with a flexible drive coupling, said first and second drive shafts having coplanar axes intersecting at about said horizontal pivot means.

13. The drive defined in claim 12 wherein said first and second shafts are connected by a flexible drive coupling.

14. The drive defined in claim 12 wherein said horizontal pivot means includes a horizontal pivot member supporting the drive.

15. The drive defined in claim 12 wherein said horizontal pivot means includes two spaced trunnion means with said flexible drive coupling positioned therebetween.

* * * * *